US007744199B2

(12) United States Patent
Yoo et al.

(10) Patent No.: US 7,744,199 B2
(45) Date of Patent: Jun. 29, 2010

(54) INK-JETTING APPARATUS AND INK-JETTING METHOD

(75) Inventors: Young-Seuck Yoo, Seoul (KR); Jae-Woo Joung, Suwon-si (KR); Young-Jae Kim, Suwon-si (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 256 days.

(21) Appl. No.: 11/902,322

(22) Filed: Sep. 20, 2007

(65) Prior Publication Data

US 2008/0074476 A1 Mar. 27, 2008

(30) Foreign Application Priority Data

Sep. 27, 2006 (KR) ..... 10-2006-0094410

(51) Int. Cl.
*B41J 2/045* (2006.01)

(52) U.S. Cl. ..... 347/71

(58) Field of Classification Search ..... 347/71, 347/68–70, 72; 400/124.16, 124.17; 310/363–366; 29/25.35

See application file for complete search history.

(56) References Cited

FOREIGN PATENT DOCUMENTS

| | | |
|---|---|---|
| JP | 2-235758 | 9/1990 |
| JP | 5-116322 | 5/1993 |
| JP | 10-181011 | 7/1998 |
| JP | 10-278267 | 10/1998 |
| JP | 2000-117999 | 4/2000 |
| JP | 2000-185392 | 7/2000 |
| JP | 2002-127428 | 5/2002 |
| JP | 2005-136151 | 5/2005 |
| JP | 10-2006-0022367 | 3/2006 |

OTHER PUBLICATIONS

Korean Office Action, dated Sep. 5, 2007.
Japanese Office Action issued on Dec. 17, 2010 in corresponding Japanese Patent Application 2007-252629.

*Primary Examiner*—K. Feggins

(57) ABSTRACT

An ink-jetting apparatus and an ink-jetting method are disclosed. An ink-jetting apparatus for jetting an ink through a nozzle which includes a chamber containing the ink, an actuator providing a pressure to the chamber, and an electrostatic part forming an electric field around the nozzle, may provide high resolution and a wide range of grey scale by using a piezoelectric method with an electrostatic method in combination.

6 Claims, 4 Drawing Sheets

INK-JETTING APPARATUS AND INK-JETTING METHOD

CROSS-REFERENCE TO RELATED APPLICATIONS

This application claims the benefit of Korean Patent Application No. 10-2006-0094410 filed with the Korean Intellectual Property Office on Sep. 27, 2006, the disclosure of which is incorporated herein by reference in its entirety.

BACKGROUND

1. Technical Field

The present invention relates to an ink-jetting apparatus and an ink-jetting method.

2. Description of the Related Art

As a method of printing minute droplets to obtain high resolution patterns, the so-called 'on demand' type ink-jet printing method is currently in use. Examples of this on-demand type ink-et printing method include the piezoelectric type, thermal type and electrostatic type.

The piezoelectric type is a method of printing that provides pressure using a piezoelectric element 60 to a chamber 30 connected to a nozzle 40, and jets droplets from the nozzle 40.

The thermal type is a method for printing that heats ink and jets droplets from a nozzle by way of the pressure of a bubble generated by the heating.

For higher resolution, it is necessary to create small droplets. Thus, in the piezoelectric type or thermal type method, the diameter of the nozzle is small. However, if the diameter of the nozzle is made small, dregs may stick to the nozzle, or the nozzle may be blocked up as the ink around the nozzle dries.

Such problems may cause the direction of the jetted ink to be changed, which is directly correlated with degraded printing quality. Thus, there is a limit to realizing high resolution by decreasing the diameter of the nozzle.

The electrostatic type, on the other hand, is a printing method that generates an electrostatic force between an object and the printer head, and moves a droplet by the electrostatic force. The electrostatic type may form extremely minute droplets compared to the size of the nozzle, and there is less risk of the nozzle being blocked up.

However, when using the electrostatic type, it is hard to manufacture the apparatus because of the complexity, and there is a need for minute controlling capability. Also, there are the complications involved with manufacturing minute structures for providing a uniform amount of ink for jetting minute droplets.

SUMMARY

An aspect of the invention is to provide an ink-jetting apparatus and an ink-jetting method for high resolution, by forming an ink tip using a piezoelectric method and by separating a part of the ink tip using an electrostatic method.

One aspect of the invention provides an ink-jetting apparatus for jetting an ink through a nozzle that includes a chamber containing the ink, an actuator providing a pressure to the chamber, and an electrostatic part forming an electric field around the nozzle.

The ink may be electrified or a power supply for electrifying the ink may be arranged. Here, the chamber may be made of doped silicon (Si), and the power supply may be connected with the chamber.

The actuator may provide pressure to the chamber such that an ink tip is formed at the nozzle, and the electrostatic part may form an electric field for separating at least a portion of the ink tip.

The actuator may include a piezoelectric element.

The electrostatic part may include an electrode layer formed adjacent to the nozzle, and a through-hole corresponding to the nozzle may be formed in the electrode layer. Here, the electrode layer may be formed in a plurality, and an insulating layer may be interposed between the electrode layers. Also, each of the electrode layers may be connected to a separate power supply.

The electrostatic part may include an opposing electrode formed adjacent to the nozzle at a distance.

Another aspect of the invention provides an ink-jetting method for jetting an ink contained in a chamber through a nozzle that includes forming an electrified ink tip at the nozzle by piezoelectric method; and separating at least a portion of the ink tip with an electrostatic force.

Forming the electrified ink tip may include electrifying an ink contained in a chamber; and forming the ink tip by providing pressure to the chamber. Here, forming the ink tip may be performed using a piezoelectric element.

Separating at least a portion of the ink tip may be performed using an electrode layer, in which a through-hole corresponding to the nozzle is formed.

The electrode layer may be formed in a plurality, and each of the electrode layers may be connected to a separate power supply.

Separating a portion of the ink tip may be performed by an opposing electrode formed adjacent to the nozzle at a distance.

Additional aspects and advantages of the present invention will become apparent and more readily appreciated from the following description, including the appended drawings and claims, or may be learned by practice of the invention.

DETAILED DESCRIPTION

The ink-jetting apparatus and the ink-jetting method according certain embodiments of the invention will be described below in more detail with reference to the accompanying drawings. In the description with reference to the accompanying drawings, those components are rendered the same reference number that are the same or are in correspondence regardless of the figure number, and redundant explanations are omitted.

First, an ink-jetting apparatus according to a first disclosed embodiment of the present invention will be described below.

Figure 1:
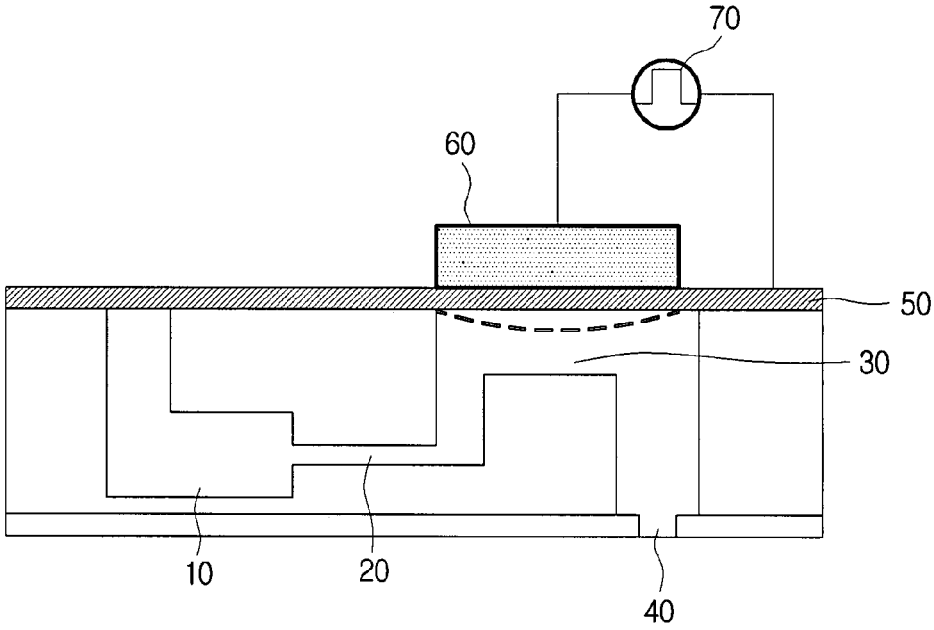
FIG. 1 PRIOR ART
FIG. 1 is a cross-sectional view of an ink-jetting apparatus according to prior art.
Figure 2:
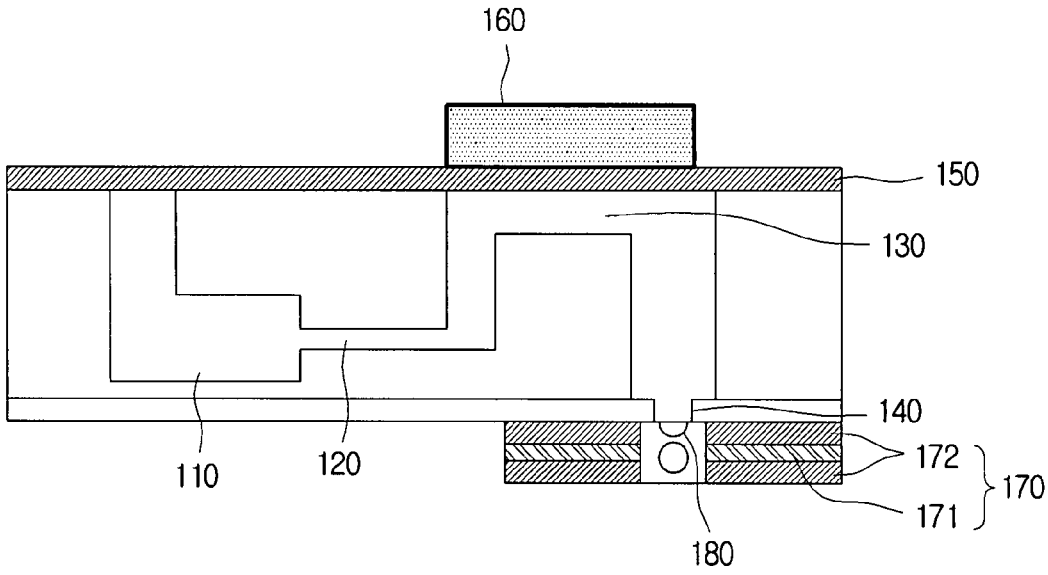
FIG. 2 is a cross-sectional view of an ink-jetting apparatus according to a first disclosed embodiment of the present invention.

FIG. 2 is a cross-sectional view of an ink-jetting apparatus according to a first disclosed embodiment of the present invention. In FIG. 2 are illustrated a reservoir 110, a restrictor 120, a chamber 130, a nozzle 140, a vibrating plate 150, a piezoelectric element 160, an electrode layer 171, an insulating layer 172 and an ink tip 180.

The reservoir 110 may contain ink, and provide the ink to the chamber 130 thorough the restrictor 120.

The restrictor 120 may serve as a channel that connects the chamber 130 with the reservoir 110, and provide ink to the chamber 130 from the reservoir 110. The restrictor 120 may be formed with a cross-sectional area smaller than that of the reservoir 110. Also, the restrictor 120 may control the amount of ink provided from the reservoir 110 to the chamber 130 when the vibrating plate 150 is made to vibrate by the piezoelectric element 160.

The chamber 130 may be connected with the reservoir 110 by the restrictor 120. Moreover, the side of the chamber 130 which is not connected with the restrictor 120 may be connected with the nozzle 140. Therefore, the chamber 130 may receive the ink from the reservoir 110 and provide the ink to the nozzle 140, whereby printing may take place.

One side of the chamber 130 may be covered by the vibrating plate 150, and the piezoelectric element 160 may be joined with the upper surface of the vibrating plate 150 corresponding to the location of the chamber 130.

The piezoelectric element 160 may be joined on the upper side of the vibrating plate 150 corresponding to the location of the chamber 130, and may generate vibrations. The piezoelectric element 160 may supply a driving pressure to the chamber 130 by receiving electrical power from the power supply and generating the vibration.

The nozzle 140 may be connected with the chamber 130, and may receive the ink from the chamber 130 and jet the ink. When a vibration generated by the piezoelectric element 160 is provided to the chamber 130 through the vibration plate, a pressure may be supplied to the chamber 130, at which the nozzle 140 may jet the ink by the pressure.

In the ink-jetting apparatus according to this embodiment, the pressure provided to the chamber 130 may be controlled such that the ink is not jetted completely through the nozzle 140, but rather an ink tip 180 is formed at the nozzle 140.

That is, by controlling the voltage applied to the piezoelectric element 160, an ink tip 180 may be formed with a convex surface at the nozzle 140, without being jetted out completely. Here, an ink tip 180 is not a drop of ink jetted out completely through the nozzle 140, but a part of the ink formed at the nozzle 140 with a convex surface.

By forming the ink tip 180, the electrostatic force may be concentrated on the ink tip 180, so that the ink may be jetted out efficiently using an electrostatic part 170.

In the ink-jetting apparatus according to this embodiment, the electrostatic part 170 may include an insulating layer 172 and an electrode layer 171.

The insulating layer 172 may isolate the electrode layer 171 from the surface in which the nozzle 140 is formed. Thus, the insulating layer 172 may be joined to the surface of an ink-jetting apparatus according to this embodiment in which the nozzle 140 is formed.

Also, in the insulating layer 172, a hole corresponding to the nozzle 140 may be formed through which the jetted ink passes. An electrode layer 171 may be stacked on the insulating layer 172.

The electrode layer 171 may form an electric field at and around the nozzle 140 so that at least a portion of the ink tip 180 is separated and a minute droplet of ink may be jetted. A hole corresponding to the nozzle 140 may be formed in the electrode layer 171, just as in the insulating layer 172, through which the jetted ink may pass.

When power is supplied to the electrode layer 171 and the electric field is formed in a direction from the inside of the nozzle 140 to the outside, an electrostatic force due to the electric field may be supplied to the electrified ink tip 180. Then, if the electrostatic force due to the electric field is larger than the surface tension of the ink tip 180, a fine droplet of ink may be separated from the ink tip 180 and jetted.

While two insulating layers 172 and one electrode layer 171 stacked in-between the insulating layers 172 are illustrated in this embodiment as forming the electrostatic part 170, the electrode layer 171 may just as well be formed in a plurality, so that the directionality of the droplet may be improved.

The electric field formed around the nozzle 140 may be controlled by forming multiple electrode layers 171, whereby the directionality of the droplets may be improved.

For increased efficiency, each of the electrode layers may be connected to a separate power supply. That is, by connecting each of the electrode layers to a separate power supply and controlling each set separately, the electric field formed around the nozzle 140 may be controlled with greater variety, which may be a principle for improving the directionality of a droplet.

Next, an ink-jetting apparatus according to a second disclosed embodiment of the present invention is described below.

Figure 3:
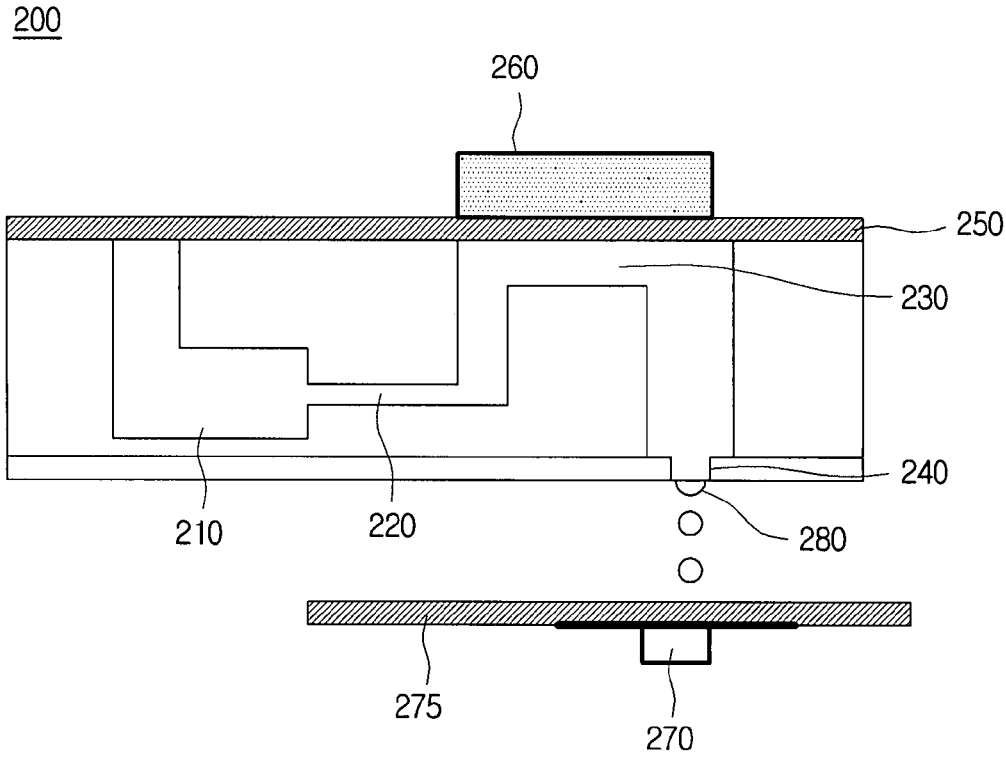
FIG. 3 is a cross-sectional view of an ink-jetting apparatus according to a second disclosed embodiment of the present invention.

FIG. 3 is a cross-sectional view of an ink-jetting apparatus according to a second disclosed embodiment of the present invention. In FIG. 3 are illustrated a reservoir 210, a restrictor 220, a chamber 230, a nozzle 240, a vibrating plate 250, a piezoelectric element 260, an opposing electrode 270, an object of printing 275 and an ink tip 280.

In the ink-jetting apparatus 200 according to this embodiment, most of the elements are the same or in correspondence to those of the first disclosed embodiment, except for the opposing electrode 270. Thus, the ink-jetting apparatus will be described below first taking into consideration the opposing electrode 270.

In the ink-jetting apparatus 200 according to this embodiment, an opposing electrode 270 is presented as an element corresponding to the electrostatic part 170 of the first disclosed embodiment.

In the first disclosed embodiment, a droplet is pushed towards the object of printing by an electrostatic part 170 formed adjacent to the nozzle 140. In this embodiment, however, the object of printing lies between the opposing electrode 270 and the nozzle 240, and a droplet may be pulled toward the printing object 275.

To be more specific, the opposing electrode may be arranged at a distance from the nozzle 240, and an electric field may be formed around the nozzle 240. The electric field may cause at least a portion of the ink tip 280 to be separated and jetted. Here, by positioning the object of printing 275 between the nozzle 240 and the opposing electrode 270, a jetted droplet may be provided to the object 275, whereby printing may take place.

Next, an ink-jetting method according to an embodiment of the present invention will be described below referring to FIG. 4. For convenience, the ink-jetting method will be described based on the assumption that the method is carried out using the ink-jetting apparatus of FIG. 3.

Figure 4:
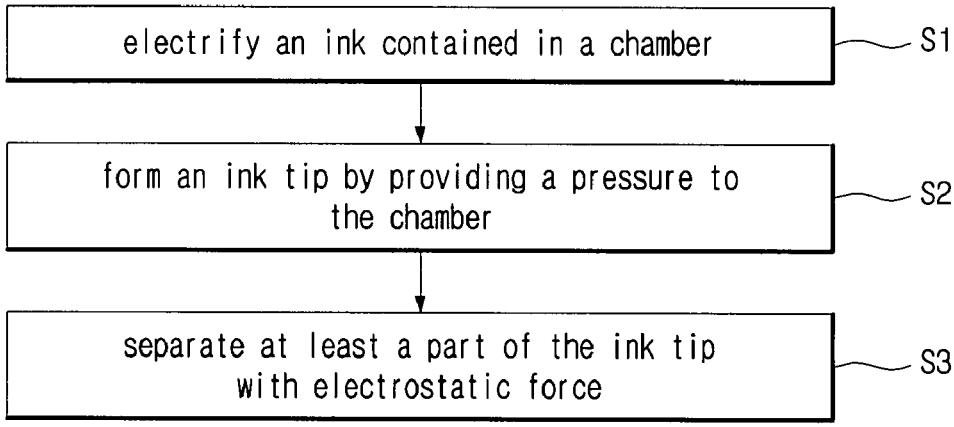
FIG. 4 is a flowchart of an ink-jetting method according to an embodiment of the present invention.

FIG. 4 is a flowchart of an ink-jetting method according to an embodiment of the present invention.

First, the ink contained in a chamber 230 may be electrified (S1). For the subsequent operation of separating a portion of the ink tip 280 by electrostatic force, which will be described below, it may be desirable that the ink tip 280 be electrified.

The electrifying may be carried out by charging the chamber 230 with an electric current. To be more specific, the ink may be electrified by forming the chamber 230 with a doped silicon wafer and supplying a power directly to the chamber 230. Alternately, it is possible to supply electrified ink to the chamber 230. As described above, it is apparent that the electrifying may be performed by any of a variety of methods.

Next, an ink tip 280 may be formed by providing pressure to the chamber 230 (S2). This is to form a structure on which to concentrate the electrostatic force. That is, it is for forming an ink tip 280 by providing pressure to the chamber 230.

For providing pressure to the chamber 230, a piezoelectric element 260 and a power supply (not shown) providing power to the piezoelectric element 260 may be used. As this operation (S2) is not for jetting a droplet of ink completely through the nozzle 240 but for forming an ink tip 280 with a convex surface at the nozzle 240, the pressure provided to the chamber 230 by the piezoelectric element 260 may be controlled. In other words, the magnitude of the power supplied to the piezoelectric element 260 may be controlled such that an ink tip 280 with a convex surface is formed at the nozzle 240.

Next, at least a portion of the ink tip 280 may be separated with electrostatic force (S3). That is, a droplet of the ink may be jetted and provided to an object of printing 275 by separating at least a portion of the ink tip 280.

To be more specific, the electrostatic force in the direction of the outside from the inside of the nozzle 240 may be supplied to the ink tip 280 by forming an electric field in the direction of the outside from the inside of the nozzle 240. If the electrostatic force supplied to the ink tip 280 is larger than the surface tension of the ink tip 280, at least a portion of the ink tip 280 may be separated from the ink tip 280. Then a droplet separated from the ink tip 280 may be leaded to an object 275 due to the electric field formed around the nozzle 240, whereby printing may take place.

The separating may be carried out, for example, using an electrostatic part 170 of the ink-jetting apparatus such as that described above. That is, the separating may be carried out with an insulating layer 172 arranged adjacent to the nozzle 140, and an electrode layer 171 stacked to the insulating layer 172. Also, it may be carried out with an opposing electrode 270 formed adjacent to the nozzle 240 at a distance. Detailed descriptions have already been presented with reference to the electrostatic part 170 of the ink-jetting apparatus set forth above.

Next, a method for implementing a wide range of grey scale by an ink-jetting method according to an embodiment of the invention will be described below. For convenience, the method will be described based on the assumption that the method is carried out by the ink-jetting apparatus described with reference to the first disclosed embodiment of the invention.

If there is a need to jet minute droplets for high resolution, as described above, an ink tip 180 may be formed by the piezoelectric element 160, and the electric field may be formed around the nozzle 140. Then, at least a portion of the ink tip 180 may be separated from the ink tip 180 by the electrostatic force created by the electric field. Here, the size of the droplet separated from the ink tip 180 may be controlled by controlling the magnitude of the electric field formed around the nozzle 140.

If, however, there is no need for high resolution, that is, if it is needed to jet a big droplet for wide printing, the operation of the electrostatic part 170 may be stopped, and the ink may be jetted directly by the piezoelectric element 160. That is, the droplet may be jetted directly, without forming an ink tip at the nozzle 140, by increasing the power supplied to the piezoelectric element 160 while stopping the supply of power to the electrostatic part 170.

With such control, minute droplets of ink may be jetted for high resolution, and big droplets of ink may also be jetted. Therefore, a wide range of grey scale can be implemented.

As described above, with an ink-jetting apparatus and an ink-jetting method, high resolution and a wide range of grey scale can be obtained by using a piezoelectric method with an electrostatic method in combination.

While the present invention has been described with reference to particular embodiments, it is to be appreciated that various changes and modifications may be made by those skilled in the art without departing from the spirit and scope of the present invention, as defined by the appended claims and their equivalents.

What is claimed is:

1. An ink-jetting method for jetting an ink contained in a chamber through a nozzle, the method comprising:

forming an electrified ink tip at the nozzle by a piezoelectric method, the forming the electrified ink tip including electrifying an ink contained in a chamber, and forming the ink tip by providing pressure to the chamber; and separating at least a portion of the ink tip with an electrostatic force.

2. The method of claim 1, wherein forming the ink tip is performed by a piezoelectric element.

3. The method of claim 1, wherein the separating is performed by an electrode layer in which a through-hole corresponding to the nozzle is formed.

4. The method of claim 3, wherein the electrode layer is formed in a plurality.

5. The method of claim 4, wherein each of the electrode layers is connected to a separate power supply.

6. The method of claim 1, wherein the separating is performed by an opposing electrode formed adjacent to the nozzle at a distance.

* * * * *